US007897550B2

(12) United States Patent
Kawamura et al.

(10) Patent No.: US 7,897,550 B2
(45) Date of Patent: Mar. 1, 2011

(54) UREA GREASE COMPOSITION FOR CONSTANT VELOCITY JOINTS

(75) Inventors: Yasushi Kawamura, Tokyo (JP); Takumi Matsumoto, Toyota (JP); Kazuhiro Miyajima, Toyota (JP); Tetsuo Nimura, Toyota (JP); Kazushige Ohmura, Tokyo (JP); Noriaki Shinoda, Tokyo (JP); Keiji Tanaka, Tokyo (JP); Takeo Yamamoto, Toyota (JP)

(73) Assignee: Shell Oil Company, Houston, TX (US)

( * ) Notice: Subject to any disclaimer, the term of this patent is extended or adjusted under 35 U.S.C. 154(b) by 908 days.

(21) Appl. No.: 10/870,258

(22) Filed: Jun. 17, 2004

(65) Prior Publication Data

US 2005/0020456 A1 Jan. 27, 2005

(30) Foreign Application Priority Data

Jun. 18, 2003 (JP) ..... 2003-174133

(51) Int. Cl.

| | |
|---|---|
| ***C10M 129/40*** | (2006.01) |
| ***C10M 137/10*** | (2006.01) |
| ***C10M 159/24*** | (2006.01) |
| ***C10M 135/18*** | (2006.01) |
| ***C10M 169/06*** | (2006.01) |

(52) U.S. Cl. ..... 508/364; 508/438; 508/391; 508/459; 508/536

(58) Field of Classification Search ..... 508/364, 508/438, 391, 459, 536
See application file for complete search history.

(56) References Cited

U.S. PATENT DOCUMENTS

| | | | | |
|---|---|---|---|---|
| 4,840,740 A | | 6/1989 | Sato et al. | 252/32.7 E |
| 5,084,193 A | * | 1/1992 | Waynick | 508/528 |
| 5,096,605 A | * | 3/1992 | Waynick | 508/163 |
| 5,449,471 A | * | 9/1995 | Ozaki et al. | 508/438 |
| 6,037,314 A | | 3/2000 | Kondo et al. | 508/363 |
| 6,214,778 B1 | * | 4/2001 | Todd | 508/518 |
| 6,794,342 B2 | * | 9/2004 | Komiya et al. | 508/485 |
| 6,894,009 B2 | * | 5/2005 | Kawamura et al. | 508/273 |

FOREIGN PATENT DOCUMENTS

| | | | |
|---|---|---|---|
| EP | 0633304 | | 1/1995 |
| EP | 0714975 | | 6/1996 |
| EP | 0761806 | | 3/1997 |
| JP | 5-79280 | | 3/1993 |
| JP | 6-57283 | | 3/1994 |
| JP | 6-330072 | | 11/1994 |
| JP | 10-147791 | | 6/1998 |
| WO | WO 0164821 | A2 * | 9/2001 |
| WO | WO 0212418 | A2 * | 2/2002 |

* cited by examiner

*Primary Examiner* — Glenn Caldarola
*Assistant Examiner* — Jim Goloboy
(74) *Attorney, Agent, or Firm* — Charles W. Stewart

(57) ABSTRACT

Urea grease composition for constant velocity joints is provided containing base oil, one or more urea thickener compounds, (A) one or more molybdenum sulphurized dialkyldithiocarbamates represented by general formula (I)

(I)

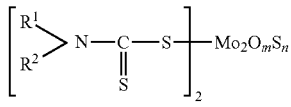

wherein $R^1$ and $R^2$ are independently chosen from alkyl groups of from 1 to 24 carbons, m+n=4, m is from 0 to 3 and n is from 4 to 1, (B) triphenylphosphorothionate represented by formula (II)

(II)

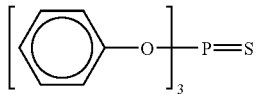

and (C) one or more stearic acid metal salts.

25 Claims, No Drawings

UREA GREASE COMPOSITION FOR CONSTANT VELOCITY JOINTS

The present invention relates to a urea grease composition for constant velocity joints.

Constant velocity joints are universal joints which can transfer motive power from an automobile engine to the wheels while maintaining a constant angular velocity and torque. Whilst propeller shafts have been used in most automobiles, modern automobile design is following the trend for front-wheel drive, and there are many types of constant velocity joints permitting this front wheel drive. Constant velocity joints that are also plunging type joints are structured such that they slide in the axial direction; it is friction resistance to this sliding that causes the source vibration that results in vibration and noise within the automobile. Thus, there is a strong demand for a grease composition that is excellent in decreasing interior joint friction.

In order to treat this kind of problem, many examples of constant velocity joints have appeared on the market that use urea greases having excellent friction properties.

The technology described in Japanese unexamined patent application H6-57283 is a grease composition for constant velocity joints, where (a) molybdenum disulphide, (b) molybdenum sulphurized dialkyldithiocarbamate and (c) lead dialkyldithiocarbamate incorporated into urea grease.

The technology described in Japanese examined patent publication H5-79280 is a grease for constant velocity joints obtained by using, in urea grease, both molybdenum dithiocarbamate and molybdenum dithiophosphate additives or by mixing zinc dithiophosphate into these organomolybdenum compounds.

The technology described in Japanese unexamined patent application H6-330072 is a grease composition for constant velocity joints, where (A) molybdenum sulphurized dialkyldithiocarbamate and (B) triphenylphosphorothionate are both added to urea grease.

The technology described in Japanese unexamined patent application H10-147791 relates to a grease composition for plunging type constant velocity joints, where molybdenum dithiocarbamate, sulphur-phosphorus-based extreme-pressure agent and oxidized wax calcium salt are mixed into urea grease.

However, although the force generated in the axial direction of a plunging type constant velocity joint (hereinbelow, the driving force) is less than when commercial grease is used, these greases described above cannot be said to be low-friction force greases that are fully satisfactory for recent constant velocity joints used under severe conditions.

In the present invention, urea grease composition(s) have been developed for use in constant velocity joints, which grease compositions exhibit advantageous decreases or inhibits the vibration generated in the constant velocity joint, and improved low friction coefficients.

The urea grease composition of the present invention is particularly suitable as a lubricant for plunging-type constant velocity joints in automobiles.

Accordingly, the present invention provides a urea grease composition for constant velocity joints, comprising base oil, at least one urea thickener compound, (A) at least one molybdenum sulphurized dialkyldithiocarbamate represented by general formula (I)

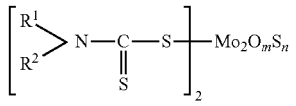

(I)

wherein $R^1$ and $R^2$ are independently chosen from alkyl groups of from 1 to 24 carbons, m+n=4, m is from 0 to 3 and n is from 4 to 1, (B) triphenylphosphorothionate represented by formula (II)

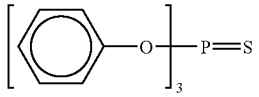

(II)

and (C) at least one stearic acid metal salt.

In a preferred embodiment of the present invention, the urea grease composition further comprises (D) at least one calcium-based dispersant.

The urea grease composition of the present invention preferably comprises from 0.5 to 10% by weight of component (A) incorporated therein, with respect to the total weight of the urea grease composition.

The urea grease composition of the present invention preferably comprises from 0.1 to 10% by weight of component (B) incorporated therein, with respect to the total weight of the urea grease composition.

The urea grease composition of the present invention preferably comprises from 0.5 to 10% by weight of component (C) incorporated therein, with respect to the total weight of the urea grease composition.

The urea grease composition of the present invention preferably comprises from 0.5 to 10% by weight of component (D) incorporated therein, with respect to the total weight of the urea grease composition.

In a preferred embodiment of the invention, the one or more urea thickener compounds are present in the urea grease composition an amount in the range of from 2 to 35% by weight, with respect to the sum of the amounts of base oil and urea thickener compounds.

If there is less than 2% by weight of urea thickener compound(s), there may be little thickening effect and the system may not readily become greasy. If there is more than 35% by weight of urea thickener compound(s), the grease may become too hard and the lubricating effect may be unsatisfactory.

The urea grease composition used in the present invention is a grease composition comprising, as base oil, a lubricating oil such as mineral oil, ester-based synthetic oil, ether-based synthetic oil, hydrocarbon-based synthetic oil, or a mixture thereof, and, as thickener, a urea thickener compound obtained by reacting aliphatic amine, alicyclic amine, aromatic amine or the like with various isocyanate compounds, and there are no particular limitations.

Base oils of mineral origin may include those produced by solvent refining or hydroprocessing. Examples of mineral oils that may be conveniently used include those sold by member companies of the Royal Dutch/Shell Group under the designations "HVI", "MVIN", or "HMVIP".

Specific examples of synthetic oils include polyolefins such as α-olefin oligomer and polybutene, polyalkylene glycols such as polyethylene glycol and polypropylene glycol, diesters such as di-2-ethyl hexyl sebacate and di-2-ethyl hexyl adipate, polyol esters such as trimethylolpropane ester and pentaerythritol ester, perfluoroalkyl ethers, silicone oils, polyphenyl ethers, either individually or as mixed oils.

Base oils of the type manufactured by the hydroisomerisation of wax, such as those sold by member companies of the Royal Dutch/Shell Group under the designation "XHVI" (trade mark), may also be used.

Mineral oil and/or synthetic oil can be used as the base oil in the grease composition of the present invention.

Urea thickener compounds that may be conveniently used as thickeners include diurea, triurea, tetraurea and the like. Typical examples of diurea compounds can be obtained by reacting diisocyanate and monoamine; examples of diisocyanates include diphenylmethane diisocyanate, phenylene diisocyanate, diphenyl diisocyanate, phenyl diisocyanate and tolylene diisocyanate, and examples of monoamines include octylamine, dodecylamine, hexadecylamine, octadecylamine and oleylamine.

All these examples of thickeners and base oils can be used either individually or as mixtures, and there are no particular limitations regarding these in the present invention.

Specific examples of the molybdenum sulphurized dialkyldithiocarbamate which may be conveniently employed as component (A) include molybdenum sulphurized diethyldithiocarbamate, molybdenum sulphurized dipropyldithiocarbamate, molybdenum sulphurized dibutyldithiocarbamate, molybdenum sulphurized dipentyldithiocarbamate, molybdenum sulphurized dihexyldithiocarbamate, molybdenum sulphurized didecyldithiocarbamate, molybdenum sulphurized diisobutyldithiocarbamate, molybdenum sulphurized di-(2-ethylhexyl)-dithiocarbamate, molybdenum sulphurized diamyldithiocarbamate, molybdenum sulphurized dilauryldithiocarbamate and molybdenum sulphurized distearyldithiocarbamate.

The amount of component (A) added is preferably in the range of from 0.5 to 10% by weight, more preferably in the range of from 0.5 to 5% by weight, with respect to the total weight of the urea grease composition.

If more than 10% by weight of component (A) is incorporated, the friction coefficient-lowering effect may not be as desired, and may become deleterious. If less than 0.5% by weight of component (A) is added, there may be no improvement in friction properties The triphenylphosphorothionate that is employed as component (B) is preferably incorporated in the urea grease composition of the present invention in an amount in the range of from 0.1 to 10% by weight, more preferably in an amount in the range of from 0.1 to 5% by weight, with respect to the total weight of the urea grease composition.

If there is less than 0.1% by weight of component (B), there may be no improvement in friction or abrasion properties. However, if there is more than 10% by weight of component (B) it may not be possible to achieve adequate lubrication.

Examples of stearic acid metal salts that may be conveniently used in the urea grease composition of the present invention as component (C) include lithium stearate, calcium stearate, sodium stearate, barium stearate, magnesium stearate, aluminium stearate, zinc stearate.

Component (C) is preferably incorporated in the urea grease composition of the present invention in an amount in the range of from 0.5 to 10% by weight, more preferably in the range of from 0.5 to 5% by weight, with respect to the total amount.

If more than 10% by weight of component (C) is incorporated, there may be no lowering of the friction properties. Furthermore, the grease may become harder and it may be difficult to achieve the desired penetration. If less than 0.5% by weight of component (C) is incorporated, the friction property improvement may be unsatisfactory.

It should be noted that whilst there are many higher fatty acids other than stearic acid, and countless similar metal salts thereof, it has been found in the present invention that only stearic acid metal salts can considerably lower the driving force of constant velocity joints. Other higher fatty acid metal salts do not result in adequate lowering of the driving force.

The calcium-based dispersants that may be conveniently used as component (D) are dispersants having calcium in the molecular structure, and dispersant refers to an additive that can disperse solids and the like in oil.

Typical examples thereof are calcium phenate, calcium sulphonate and calcium salicylate, although component (D) is not limited thereto.

Component (D) is preferably incorporated in an amount in the range of from 0.5 to 10% by weight, more preferably in the range of from 1 to 7% by weight, with respect to the total weight of the urea grease composition.

If less than 0.5% by weight of component (D) is added, there may be no adequate dispersion effect or lubrication, and if more than 10% by weight of component (D) is added, the grease may become soft.

In order to further improve the properties of the urea grease composition of the present invention, additional additives such as antioxidants, rust-preventing agents, extreme-pressure agents, polymers and the like can also be incorporated therein.

For example, antioxidants including alkylphenol, hindered phenol, alkylamine, diphenylamine and triazine antioxidants; anticorrosion agents including calcium sulphonate, sodium sulphonate, barium sulphonate and amino derivatives or metal salts of carboxylic acids; and extreme pressure agents including sulphurized oils or fats, sulphurized olefins, phosphoric acid esters, tricresyl phosphate, trialkyl thiophosphates and triphenyl phosphorothionates may be conveniently used.

Lubricants for constant velocity joints may advantageously contain the urea grease composition of the present invention.

Accordingly, the present invention further provides a method of lubricating a constant velocity joint comprising packing the constant velocity joint with the urea grease composition described above. A constant velocity joint packed with the urea grease composition is also provided.

The present invention further provides the use of the urea grease composition as a friction-reducing and vibration-reducing grease composition and, in particular, the use of said grease composition to reduce friction and/or vibration in a constant velocity joint.

The present invention is described below with reference to the following Examples, which are not intended to limit the scope of the present invention in any way.

EXAMPLES

The urea grease composition for constant velocity joints in the Working Examples and Comparative Examples below was obtained by adding additives to a urea base grease composition comprising base oil and urea thickener compound, in the proportions shown in Tables 1 to 5, and treating the resulting system using a three-roller mill. Purified mineral oil having a kinematic viscosity of 15 $mm^2/s$ at 100° C. was used as the afore-mentioned base oil.

The additives used in the Working Examples were zinc stearate and aluminium stearate, which are typical examples of component (C), and calcium salicylate and calcium sulphonate were used as component (D).

In Working Examples 1 to 5, 4 types of additive were incorporated into the urea base grease composition, i.e. component (A), component (B), component (C) and component (D).

In Working Example 6, component (A), component (B) and component (C) were incorporated into the urea base grease composition.

In Comparative Examples 1 to 6, two or three components selected from components (A), (B), (C) and (D) were incorporated into the urea base grease composition.

In Comparative Example 7, components (A) and (B) were incorporated into the urea base grease composition. The composition of said comparative Example corresponds to the composition disclosed in Japanese unexamined patent H6-330072.

The diurea grease in Tables 1 to 5 was obtained by reacting 2 mol of diphenylmethane diisocyanate with 2 mol of octylamine and 2 mol of oleyl amine, and uniformly dispersing the resulting urea thickener compound, in base oil. The resulting urea base grease composition had a penetration (25° C., 60 W) of 268, and a dropping point of 221° C. It should be noted that the urea thickener compound content therein was 10% by weight, with respect to the sum of the amounts of base oil and urea thickener compound.

The tetraurea grease in Tables 2 and 4 was obtained by reacting 2 mol of diphenylmethane diisocyanate with 1 mol of octylamine, 1 mol of laurylamine and 1 mol of ethylene diamine, and uniformly dispersing the resulting urea compound, in base oil. The resulting urea base grease composition had a penetration (25° C., 60 W) of 325, and a dropping point of 253° C. It should be noted that the urea thickener compound content therein was 13% by weight, with respect to the sum of the amounts of base oil and urea thickener compound.

The penetration, dropping point and friction coefficient shown in the Tables were appraised by performing the following tests.

(1) Penetration

The penetration was measured according to the JIS K2220 penetration test method.

(2) Dropping Point

The dropping point was measured according to the JIS K2220 dropping point test method.

(3) Friction Coefficient

Of the numerous friction and abrasion test apparatuses, the SRV test apparatus, with a high correlation with driving force, was used; the friction coefficient was found under the following test conditions.

Test sample: bowl (Φ17.5 mm)/plate
Load: 300 N
Slip speed: 0.18 m/s
Temperature: room temperature
Time: 10 min
Grease: approximately 1 g coating of grease on the test sample Tables 1 to 5 also show an appraisal of whether the grease composition was satisfactory when used on a constant velocity joint, with the grease composition of Comparative Example 7 taken as the standard reference grease.

TABLE 1

| Working Example | | 1 | 2 | 3 |
|---|---|---|---|---|
| Base grease (% wt.) | Diurea grease | 91.0 | 91.0 | 91.0 |
| | Tetraurea grease | — | — | — |

TABLE 1-continued

| Working Example | | 1 | 2 | 3 |
|---|---|---|---|---|
| Additive (% wt.) | A*1 | 3.0 | 3.0 | 3.0 |
| | B*2 | 2.0 | 2.0 | 2.0 |
| | C-1*3 | 2.0 | 2.0 | — |
| | C-2*4 | — | — | 2.0 |
| | D-1*5 | 2.0 | — | 2.0 |
| | D-2*6 | — | 2.0 | |
| Penetration 60 W | | 275 | 276 | 272 |
| Dropping point (° C.) | | 216 | 214 | 212 |
| Friction coefficient by SRV test | | 0.034 | 0.034 | 0.038 |
| Satisfaction when used in constant velocity joint | | ● | ● | ○ |

● Excellent driving force-reducing effect
○ Good driving force-reducing effect
□ No effect
X High driving force
*1 A is molybdenum sulphurized dialkyldithiocarbamate, the alkyl group is C4, n is a mixture of 2 and 3.
*2 B is triphenylphosphorothionate.
*3 C-1 is a stearic acid metal salt, the metal is zinc.
*4 C-2 is a stearic acid metal salt, the metal is aluminium.
*5 D-1 is a calcium-based dispersant, calcium salicylate.
*6 D-2 is a calcium-based dispersant, calcium sulphonate.

TABLE 2

| Working Example | | 4 | 5 | 6 |
|---|---|---|---|---|
| Base grease (% wt.) | Diurea grease | 91.0 | — | 93.0 |
| | Tetraurea grease | — | 91.0 | — |
| Additive (% wt.) | A*1 | 3.0 | 3.0 | 3.0 |
| | B*2 | 2.0 | 2.0 | 2.0 |
| | C-1*3 | — | 2.0 | — |
| | C-2*4 | 2.0 | — | 2.0 |
| | D-1*5 | — | 2.0 | — |
| | D-2*6 | 2.0 | — | — |
| Penetration 60 W | | 272 | 336 | 338 |
| Dropping point (° C.) | | 215 | 242 | 241 |
| Friction coefficient by SRV test | | 0.040 | 0.036 | 0.042 |
| Satisfaction when used in constant velocity joint | | ○ | ● | ○ |

TABLE 3

| Comparative Example | | 1 | 2 | 3 |
|---|---|---|---|---|
| Base grease (% wt.) | Diurea grease | 93.0 | 95.0 | 95.0 |
| | Tetraurea grease | — | — | — |
| Additive (% wt.) | A*1 | 3.0 | — | — |
| | B*2 | — | 3.0 | — |
| | C-1*3 | 2.0 | — | — |
| | C-2*4 | | | 2.0 |
| | D-1*5 | 2.0 | 2.0 | |
| | D-2*6 | | | 3.0 |
| Penetration 60 W | | 274 | 272 | 279 |
| Dropping point (° C.) | | 213 | 216 | 211 |
| Friction coefficient by SRV test | | 0.061 | 0.120 | Burnt |
| Satisfaction when used in constant velocity joint | | X | X | X |

TABLE 4

| Comparative Example | | 4 | 5 | 6 |
|---|---|---|---|---|
| Base grease (% wt.) | Diurea grease | 93.0 | — | 93.0 |
| | Tetraurea grease | — | 95.0 | — |
| Additive (% wt.) | A*1 | 3.0 | 3.0 | 3.0 |
| | B*2 | 2.0 | — | 2.0 |
| | C-1*3 | — | — | — |
| | C-2*4 | — | 2.0 | — |
| | D-1*5 | 2.0 | — | — |
| | D-2*6 | — | — | 2.0 |

TABLE 4-continued

| Comparative Example | 4 | 5 | 6 |
|---|---|---|---|
| Penetration 60 W | 272 | 328 | 298 |
| Dropping point (° C.) | 217 | 246 | 211 |
| Friction coefficient by SRV test | 0.057 | Burnt | 0.070 |
| Satisfaction when used in constant velocity joint | □ | X | □ |

TABLE 5

| Comparative Example | | 7 |
|---|---|---|
| Base grease (% wt.) | Diurea grease | 95.0 |
| | Tetraurea grease | — |
| Additive (% wt.) | A*1 | 3.0 |
| | B*2 | 2.0 |
| | C-1*3 | — |
| | C-2*4 | — |
| | D-1*5 | — |
| | D-2*6 | — |
| Penetration 60 W | | 269 |
| Dropping point (° C.) | | 220 |
| Friction coefficient by SRV test | | 0.071 |
| Satisfaction when used in constant velocity joint | | Standard |

The grease compositions of Working Examples 1 to 5, which comprised component (A), component (B) component (C) and component (D) incorporated as additives, and the grease composition of Working Example 6, which was obtained using component (A), component (B) and component (C), afforded much lower friction coefficients than those of Comparative Examples 1 to 7, which comprised any two or three of components (A), (B) and (C) as additives. Also, Working Examples 1 to 6 afforded a better decrease in driving force than Comparative Example 7, which was the known composition of Japanese unexamined patent H6-330072.

It is evident that the present invention provides a urea grease composition which can inhibit vibration in constant velocity joints, and can considerably lower the friction coefficient.

We claim:

1. An urea grease composition for constant velocity joints, comprising base oil, at least one urea thickener compound, (A) at least one molybdenum sulphurized dialkyldithiocarbamate represented by general formula (I)

(I)

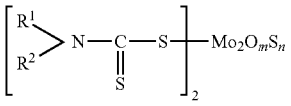

wherein $R^1$ and $R^2$ are independently chosen from alkyl groups of from 1 to 24 carbons, m+n=4, m is from 0 to 3 and n is from 4 to 1, (B) triphenylphosphorothionate represented by formula (II)

(II)

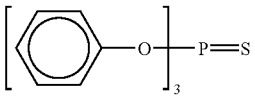

(C) at least one stearic acid metal salt present in the urea grease composition in the range from 0.5 to 10% by weight with respect to the total weight of the urea grease composition, wherein the stearic acid metal salt is either zinc stearate or aluminum stearate;

and (D) at least one calcium based dispersant.

2. The urea grease composition of claim 1, wherein component (D) is present in the urea grease composition in an amount in the range of from 0.5 to 10% by weight.

3. The urea grease composition of claim 1 wherein from 0.5 to 10% by weight of component (A) is incorporated therein, with respect to the total weight of the urea grease composition.

4. The urea grease composition of claim 1 wherein from 0.1 to 10% by weight of component (B) is incorporated therein, with respect to the total weight of the urea grease composition.

5. The urea grease composition of claim 4, wherein the at least one calcium-based dispersant is selected from the group consisting of calcium phenate, calcium sulphonate and calcium salicylate.

6. The urea grease composition of claim 2 wherein from 1 to 7% by weight of component (D) is incorporated therein with respect to the total weight of urea grease composition.

7. The urea grease composition of claim 1 wherein from 2 to 35% by weight of at least one urea thickener compound is incorporated therein with respect to the sum of the amounts of base oil and urea thickener compounds.

8. The urea grease composition of claim 2 wherein from 2 to 35% by weight of at least one urea thickener compound is incorporated therein with respect to the sum of the amounts of base oil and urea thickener compounds.

9. A method of lubricating a constant velocity joint, comprising packing the constant velocity joint with the urea grease composition of claim 1.

10. A method of lubricating a constant velocity joint, comprising packing the constant velocity joint with the urea grease composition of claim 2.

11. A method of lubricating a constant velocity joint, comprising packing the constant velocity joint with the urea grease composition of claim 7.

12. A constant velocity joint packed with the urea grease composition of claim 1.

13. A constant velocity joint packed with the urea grease composition of claim 2.

14. A constant velocity joint packed with the urea grease composition of claim 3.

15. A constant velocity joint packed with the urea grease composition of claim 4.

16. A constant velocity joint packed with the urea grease composition of claim 6.

17. A constant velocity joint packed with the urea grease composition of claim 7.

18. An urea grease composition for constant velocity joints, comprising base oil, at least one urea thickener compound, (A) at least one molybdenum sulphurized dialkyldithiocarbamate represented by general formula (I)

(I)

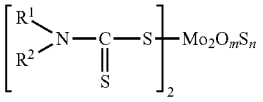

wherein $R^1$ and $R^2$ are independently chosen from alkyl groups of from 1 to 24 carbons, m+n=4, m is from 0 to 3 and n is from 4 to 1, (B) triphenylphosphorothionate represented by formula (II)

(II)

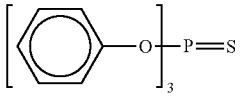

and (C) at least one stearic acid metal salt present in the urea grease composition in the range from 0.5 to 5% by weight with respect to the total weight of the urea grease composition, further comprising (D) at least one calcium-based dispersant; and wherein the at least one stearic acid metal salt is either zinc stearate or aluminum stearate or a combination thereof.

19. A constant velocity joint packed with the urea grease composition of claim 18.

20. The urea grease composition of claim 18, wherein the at least one calcium-based dispersant includes the compounds selected from the group consisting of calcium phenate, calcium sulphonate, and calcium salicylate that is present in the urea grease composition in the range of from 0.5 to 10% by weight based on the total weight of the urea grease composition.

21. The urea grease composition of claim 20, wherein component (A) is present in the urea grease composition in the range of from 0.5 to 10% by weight with respect to the total weight of the urea grease.

22. The urea grease composition of claim 21, wherein component (B) is present in the urea grease composition in the range of from 0.1 to 10% by weight with respect to the total weight of the urea grease.

23. The urea grease composition of claim 22, wherein the urea thickener compounds are present in the urea grease composition in the range of from 2 to 35% by weight with respect to the sum of the amounts of base oil and urea thickener compounds.

24. The urea grease composition of claim 23, wherein the base oil is a mineral oil or a synthetic oil, or a combination of both.

25. The urea grease composition of claim 24, wherein component (A) is present in the urea grease composition in the range of from 0.5 to 5% by weight with respect to the total weight of the urea grease; wherein component (B) is present in the urea grease composition in the range of from 0.1 to 5% by weight with respect to the total weight of the urea grease; wherein the at least one stearic acid metal salt is present in the urea grease in the range of from 0.5 to 5% by weight with respect to the total weight of the urea grease; and wherein the at least one calcium-based dispersant is present in the urea grease composition in the range of from 1 to 7% by weight based on the total weight of the urea grease composition.

* * * * *